US007510080B2

(12) United States Patent
Smart et al.

(10) Patent No.: US 7,510,080 B2
(45) Date of Patent: Mar. 31, 2009

(54) SMART EVIDENCE AND BAGGAGE SYSTEM

(75) Inventors: Colin Smart, Burley (GB); Simon Pennells, Shipley (GB); Mark Pittaway, Tong Village (GB)

(73) Assignee: TSG Associates, Ltd., Leeds (GB)

( * ) Notice: Subject to any disclaimer, the term of this patent is extended or adjusted under 35 U.S.C. 154(b) by 266 days.

(21) Appl. No.: 11/344,923

(22) Filed: Feb. 1, 2006

(65) Prior Publication Data

US 2007/0175774 A1 Aug. 2, 2007

(51) Int. Cl.
*B65D 33/00* (2006.01)

(52) U.S. Cl. ..... 206/570; 206/459.5; 206/807; 383/5

(58) Field of Classification Search ..... 383/5, 383/61, 93, 107; 206/223, 459.5, 807, 813, 206/570

See application file for complete search history.

(56) References Cited

U.S. PATENT DOCUMENTS

| | | | | |
|---|---|---|---|---|
| 4,709,399 | A * | 11/1987 | Sanders | 383/66 |
| 5,005,230 | A | 4/1991 | Congdon | |
| 5,366,087 | A * | 11/1994 | Bane | 206/459.5 |
| 5,666,445 | A * | 9/1997 | Conrad et al. | 383/207 |
| 5,788,377 | A | 8/1998 | Vetter | |
| 5,947,604 | A | 9/1999 | Bang et al. | |
| 6,468,477 | B1 | 10/2002 | Hamilton et al. | |
| 2002/0074245 | A1 | 6/2002 | Myhre | |
| 2004/0144684 | A1 | 7/2004 | McIntee et al. | |
| 2005/0121346 | A1 | 6/2005 | Cummings et al. | |

FOREIGN PATENT DOCUMENTS

| | | |
|---|---|---|
| FR | 2669305 | 5/1992 |
| GB | 2115690 | 9/1983 |
| WO | WO 2006/086759 A2 | 3/2008 |

OTHER PUBLICATIONS

European Search Report for European Patent Application No. 07 10 1329 dated May 15, 2007, which is the EP counterpart of U.S. Appl. No. 11/344,923. Two of the three references cited in the European Search Report are cited here, as the third—FR 2669305, was already cited in the May 8, 2006 IDS.

"Keep It Together" JEMS, Aug. 2005, p. 112.

* cited by examiner

*Primary Examiner*—Jacob K Ackun, Jr.
(74) *Attorney, Agent, or Firm*—Moore & Van Allen, PLLC

(57) ABSTRACT

A closable bag for use in storing items removed from injured, ill, or deceased persons. The bag is suitably of flexible, plastic. The bag has a bag mouth area providing an opening to the bag, a detachable segment disposed in the mouth area and having an aperture and having a bar code number on an exterior surface of the detachable segment, a bag main portion having a recordation area on an exterior surface of the bag main portion and having a corresponding bar code number on an exterior surface of the bag main portion, a closure member in the bag main portion and near the bag mouth area, and a perforated tear strip disposed between the closure member and the opening to the bag mouth area. Also, a kit including a container for storing one or more of the bags. Also, a method for storing personal items, removed from injured and/or ill persons, or from deceased persons, in one or more of the bags.

9 Claims, 3 Drawing Sheets

SMART EVIDENCE AND BAGGAGE SYSTEM

BACKGROUND OF INVENTION

The present invention is directed to a bag system and associated kit, and also a related method, for storing the personal property of injured and/or ill persons, or the personal property of deceased persons, where the personal property has been removed from such persons, for instance, in an emergency vehicle (i.e., an ambulance), a hospital or a nursing home, but particularly in emergency situations, for instance in a damaged area after a hurricane has passed through the area.

The following abbreviations are employed here.

| ABBREVIATIONS | |
|---|---|
| BCN | bar code number |
| DOB | date of birth |
| F | flap |
| MO | mouth opening |
| PI | personal item |
| RA | recordation area |
| RB | rubber band |
| WL | warning label |
| WD | writing device |

Flexible plastic storage bags are well known. Generally, the bags are made from thermoplastic film. Such plastic material is substantially fluid impermeable, relatively inexpensive, and can be manufactured in transparent form, which facilitates content identification. Typically, the bags have two side walls which are sealed (such as by heat sealing with heat sealing equipment) around the side and bottom edges, and also have a top, open mouth area, which, after insertion of an item into the bag, also can be heat sealed for closure of the bag. However, such plastic storage bags often are provided, in the region of the mouth area, with a closure member, such as an adhesive sealing area or such as mating male and female profiles, for instance, the ZIPLOC® feature (trademark originally assigned to Dow Chemical Company and subsequently assigned to S.C. Johnson Home Storage, Inc.).

More particularly, the closure member can be an adhesive area that is covered with a pull-off protective cover strip, typically of plastic, paper, and the like, so that in use when the protective cover strip is pulled off, the uncovered adhesive area can be folded over to close the bag at the bag mouth. Often, a mating surface is provided to which the uncovered adhesive area is positioned for bag closure, but the uncovered adhesive area can be simply positioned on a part of the plastic by the bag mouth in order to close the bag. As is well known, such adhesive area closure members are tamper evident, since after the bag mouth is closed, the adhesive seal cannot be opened without compromising the closed adhesive seal in one manner or another.

Alternatively, the closure member can be mating male and female profiles such as those provided under the ZIPLOC® trademark, where the male profile includes a linear tab adapted to be interlocked with a linear groove of the female profile. The male and female profiles are connected to close the bag at the bag mouth by pinching and pulling across the male and female profiles along their length, such as with the thumb and forefinger of a user or through the use of a sliding element optionally mounted to the male and female profiles. As is well known, such male profile/female profile closure members can be closed and then re-opened, and thus, such closure members for a bag mouth are not tamper evident.

Such plastic bags with a closure member at the mouth lend themselves well to storing personal property that has been removed from injured, ill, or deceased persons, and previous research and developments in the field have resulted in several methods for storing and identifying items removed from an injured, ill, or deceased person, particularly during emergency situations, many of which methods are discussed below.

For instance, U.S. Patent Application Publication No. 2005/0121346 A1 to Cummings, et al., published Jun. 9, 2005, and U.S. Pat. No. 5,005,230 to Congdon, issued Apr. 9, 1991, each discloses a container attached to a stretcher. The injured and/or ill person is placed on the stretcher, and items removed from injured and/or ill person are placed in a plastic bag, which is then placed in the container. As shown in U.S. Patent Application Publication No. 2005/0121346 A1, the plastic bag preferably has an adhesive seal, such that once items are placed in the plastic bag and the plastic bag is closed at its mouth via the adhesive seal, the adhesive seal is tamper evident should the plastic bag be re-opened.

Also of interest is U.S. Patent Application Publication No. 2004/0144684 A1 to McIntee, published Jul. 29, 2004, which discloses a kit for use by rescue workers. The kit consists of a plastic bag labeled bio-hazard, a blanket for placement over a person in order to protect the person from glass during extrication of the person from a vehicle involved in a collision, gloves to be worn by the rescue worker, and a carrying case for the plastic bag, the blanket, and the gloves. After finishing use of the blanket with the injured person, the blanket and the gloves are placed inside the plastic bag.

Also of interest is U.S. Patent Application Publication No. 2002/0074245 A1 to Myhre, published Jun. 20, 2002, which discloses a multi-compartment, soft fabric bag for keeping objects, such as a shroud, needed in connection with the death of a person. The bag has a conventional zipper which is opened and once the shroud and other items are removed from the bag and used with the deceased person, the empty bag can then be used for storing the person's belongings, such as pieces of jewelry, clothing, shoes, etc., and then zippered closed.

Of background interest are UK Published Patent Application No. GB 2,115,690 A, to Kelly, published Sep. 14, 1983, and French Patent No. 2,669,305 to Gerard, published May 22, 1992. UK Published Patent Application No. GB 2,115,690 A discloses a body bag for a corpse where the bag exterior has a pouch for receiving medical records. French Patent No. 2,669,305 discloses a bag tie that has a bar code on it, where the bag tie has a pointed end that during use is inserted into an aperture located at the other end of the bag tie.

Also of background interest is U.S. Pat. No. 6,468,477 to Hamilton, et al., issued Oct. 22, 2002, which discloses an air sampling bag of expandable plastic material such as polyester, and having a tube for sampling breath intake from a person's lungs, and having an adhesive patch for sealing the bag after taking a sample of the person's breath. An outer shell, such as metal foil, is also provided to capture the air sample should the expandable bag fail.

Additionally of background interest, U.S. Pat. No. 5,947,604 to Bang, et al., issued Sep. 7, 1999, discloses a plastic bag useful for protecting luggage, which plastic bag has an adhesive closure for the bag mouth. After luggage is placed in the plastic bag and the plastic bag is closed at its mouth via the adhesive seal, the adhesive seal is tamper evident should the plastic bag be re-opened.

The disclosures of all patents and published patent applications, which are mentioned here, are incorporated by reference.

SUMMARY OF INVENTION

The present invention provides a closable bag for use in storing items removed from injured, ill, or deceased persons. The bag is suitably made of flexible, plastic. The bag has a bag mouth area providing an opening to the bag, a detachable segment disposed in the mouth area and having an aperture and having a bar code number on an exterior surface of the detachable segment, a bag main portion having a recordation area on an exterior surface of the bag main portion and having a corresponding bar code number on an exterior surface of the bag main portion, a closure member in the bag main portion and near the bag mouth area, and a perforated tear strip disposed between the closure member and the opening to the bag mouth area.

Furthermore, the present invention provides a kit which comprises one or more closable bags for use in storing items removed from injured, ill, or deceased persons, and a container adapted for storing the bag or bags. Each bag comprises a bag mouth area providing an opening to the bag, a detachable segment disposed in the bag mouth area and having an aperture and having a bar code number on an exterior surface of the detachable segment, a bag main portion having a recordation area on an exterior surface of the bag main portion and having a corresponding bar code number on an exterior surface of the bag main portion, a closure member in the bag main portion and near the bag mouth area, and a perforated tear strip disposed between the closure member and the opening to bag mouth area. Optionally, the kit may further include one or more of: (a) one or more warning labels, each label being disposed on an exterior surface of a bag main portion, being adapted for disposition on an exterior surface of a bag main portion, or a combination thereof, (b) a collapsible box, or (c) a writing device, whereby the container is adapted for storing the storing the bag or bags, the warning label or labels, the writing device, and the collapsible box.

Additionally, the present invention provides a method comprising taking to an emergency area where there are one or more injured persons, ill persons, or deceased persons, a kit. The kit comprises a container having therein: one or more bags. Each bag has a bag mouth area providing an opening to the bag, a detachable segment disposed in the mouth area and having an aperture and having a bar code number on an exterior surface of the detachable segment, a bag main portion having a recordation area on an exterior surface of the bag main portion and having a corresponding bar code number on an exterior surface of the bag main portion, a closure member in the bag main portion and near the bag mouth area, and a perforated tear strip disposed between the closure member and the opening to bag mouth area. The method further comprises removing a bag from the container, removing one or more personal items from an injured person, an ill person, or a deceased person, and placing the item or items in the bag; and followed by in any order: closing the bag via the closure member; detaching the detachable segment from the bag main portion by way of the perforated tear strip; tagging the injured person, ill person, or deceased person with the detached segment; and recording personal information for the person on the recordation area. Optionally, the method may further comprise including in the kit one or more of: (i) a writing device, (ii) a collapsed box, or (iii) one or more warning labels, each label being disposed on an exterior surface of a bag main portion, being adapted for disposition on an exterior surface of a bag main portion, or a combination thereof.

The invention is now discussed in connection with the accompanying Figures and Example as best described below.

DESCRIPTION

Figure 1:
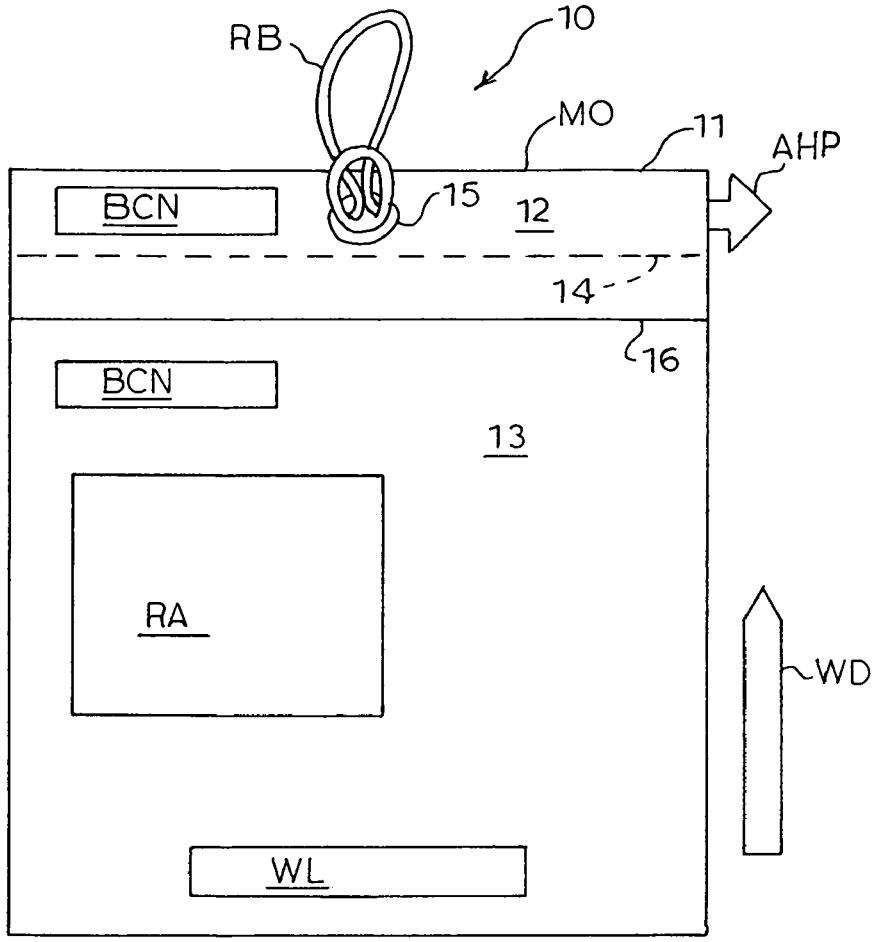
FIG. 1 is a plan view illustrating an embodiment of the bag of the present invention, and also illustrating an optional writing device for use with the bag.

As used here, certain terminology is for convenience only and is not to be taken as a limitation on the invention. For instance, words such as "upper," "lower," "left," "right," "top," "bottom," "side," "horizontal," "vertical," "back," "front," "upward," and "downward" merely describe the configuration shown in the Figures. It is understood that the components may be in any direction and the terminology, therefore, should be understood as encompassing such variations unless specified otherwise.

As noted above, the present invention comprises a bag system and associated kit, and also a related method, for storing the personal property of injured and/or ill persons, or the personal property of deceased persons, where the personal property has been removed from such persons, for instance, in an emergency vehicle (i.e., an ambulance), a hospital or a nursing home, but particularly in emergency situations. Personal property of such persons is intended to include items, such as clothing, jewelry, wallets, etc., that may need to be removed from the person.

With reference now to the Figures, whenever possible, the same reference numerals and letters are used throughout to refer to the same or like parts.

More specifically, shown in FIG. 1 is flexible, plastic bag 10, preferably of transparent thermoplastic material, for storage of the above-noted personal items that have been removed from an injured and/or ill person, or from a deceased person. Bag 10 has bag top mouth area 11 providing a bag mouth opening MO to bag 10, and also has detachable segment 12 disposed in the region of bag mouth area 11. Additionally, bag 10 has bag bottom main portion 13. Typically, segment 12 is made detachable from bag main portion 13 by the provision of a perforated tear strip 14 in bag mouth area 11 of bag 10. Optionally provided with bag 10 is writing device WD.

Figure 2:
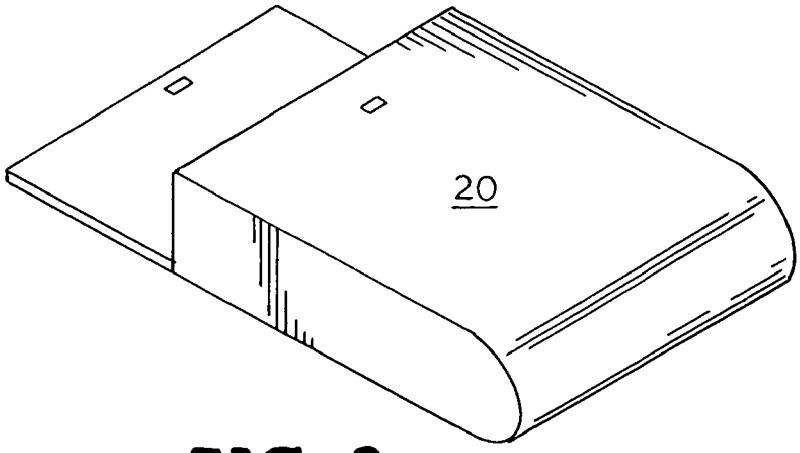
FIG. 2 is a perspective view of a pouch or container for placement of the bag or bags, and optional writing device, as illustrated in FIG. 1, so that the pouch or container, bag(s), and writing device comprise a kit.

FIG. 2 shows container or pouch 20 into which may be placed bag 10 and optional writing device WD, so that container or pouch 20, bag 10 (optionally several bags 10, for instance 2 to 100 bags), and optional writing device WD comprise a kit. As depicted in FIG. 2, container or pouch 20 is closable by conventional means. As is well known for containers or pouches, container or pouch 20 may have a handle (not shown) for convenience in carrying container or pouch 20.

Figure 3A:
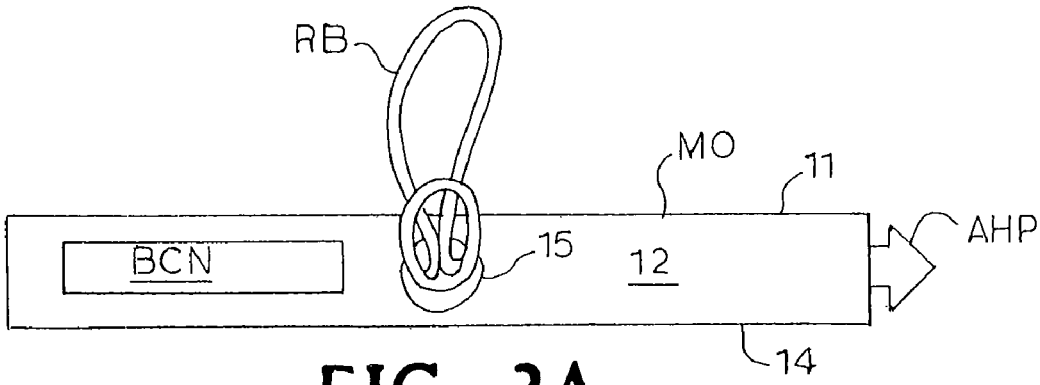
FIG. 3A is plan view of the top detachable segment of the bag, after detachment from the bag, as illustrated in FIG. 1.
Figure 3B:
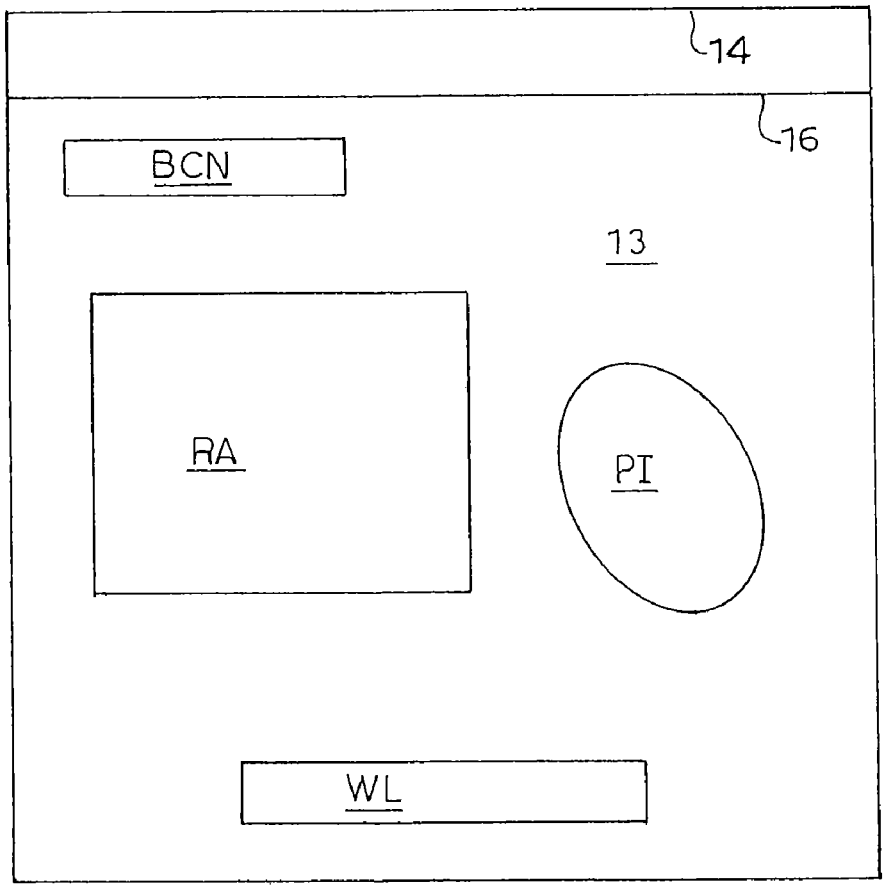
FIG. 3B is a plan view of the remaining bottom main portion of the bag, after detachment from the top detachable segment of the bag, as illustrated in FIG. 1, and showing an item or items stored inside the bag.

FIGS. 3A and 3B respectively show segment 12 and bag main portion 13 after detachable segment 12 has been detached from bag main portion 13 by way of perforated tear strip 14. FIG. 3B also shows personal items PI that have been removed from the relevant person and stored in bag 10.

Detachable segment 12 is provided with aperture 15 so that when segment 12 is detached from bag main portion 13, segment 12 is used to tag the injured and/or ill person, or the deceased person, as follows.

Optionally, aperture 15 may be provided with a stretchable band, such as rubber band RB, connected there through, so that when segment 12 is detached, segment 12 via rubber band RB can be used for tagging the person. Alternatively, there may be no rubber band RB, and instead detachable segment 12 optionally may be provided with a pointed arrow-head portion AHP adapted for insertion into aperture 15 so that when segment 12 is detached it forms a tie, such as that disclosed in the above-noted French Patent No. 2,669,305, and the tie can be used for tagging the person by inserting arrow-head portion AHP into aperture 15.

Also, bag 10 is provided with closure member 16 disposed in main portion 13 and near mouth 11, so that perforated tear strip 14 is situated between closure member 16 and mouth opening MO to the bag mouth area mouth 11. After the person's property PI has been placed in bag 10, bag 10 can be closed via closure member 16.

Closure member 16 may comprise an adhesive area that is covered with a pull-off protective cover strip (not shown), typically of plastic, paper, and the like, so that in use when the protective cover strip is pulled off, the uncovered adhesive area can be folded over to close bag 10 at bag mouth area 11, such as the adhesive seal shown in FIG. 7 of U.S. Patent Application Publication No. 2005/0121346 A1 mentioned above. That closure member 16 comprises an adhesive area is preferred, as adhesive seals are tamper evident. However, closure member 16 may be another type of closure member, such as mating male and female profiles, for instance, those provided under the above-mentioned ZIPLOC® trademark. As adhesive type of closure members and ZIPLOC® type of closure members are well known, they are generally represented as closure member 16 and not shown in detail in the Figures.

Also, bag main portion 13 of bag 10 has recordation area RA on an exterior bag surface, and as noted above, optionally provided with bag 10 is writing device WD, such as a marker, pen, or pencil for writing information on recordation area RA.

Additionally, segment 12 of bag 10 has bar code number BCN disposed on an exterior surface of detachable segment 12, and bag 10 has corresponding bar code number BCN on an exterior surface of bag main portion 13. In other words, both bag main portion 13 of bag 10 and detachable segment 12 of bag 10 have corresponding bar code numbers BCN thereby helping emergency service personnel or others to reunite injured and/or ill persons with their property after the event, or helping emergency service personnel or others to associate with which deceased person the property belonged. As is known in the art, bar code numbers BCN may be pre-printed during manufacture onto both bag main portion 13 of bag 10 and detachable segment 12 of bag 10, or bar code numbers BCN may be in the form of pull-off adhesive strips, disposed on a backing of plastic, paper, and the like, so that the strips are pulled off the backing and then placed onto bag main portion 13 and detachable segment 12, to which the strips adhere due to the adhesive. As is also known in the art, such bar code numbers BCN are easily readable with a bar code scanner (not shown).

Lastly, if any personal items PI are contaminated items, they should be separated from other personal items and placed in another, separate plastic bag 10, having optional warning label WL disposed on bag 10. Such warning label WL advises of dangerous and/or hazardous contaminants by such warning label WL containing words such as "contents contaminated with chemical, radiological, or biological agent(s)", and/or containing pictorial information hazard symbols for such words. Also preferably, warning label WL contains a portion for any personnel who handle the bag to write on that portion what the dangerous contaminants are, if such personnel know.

Figure 4:
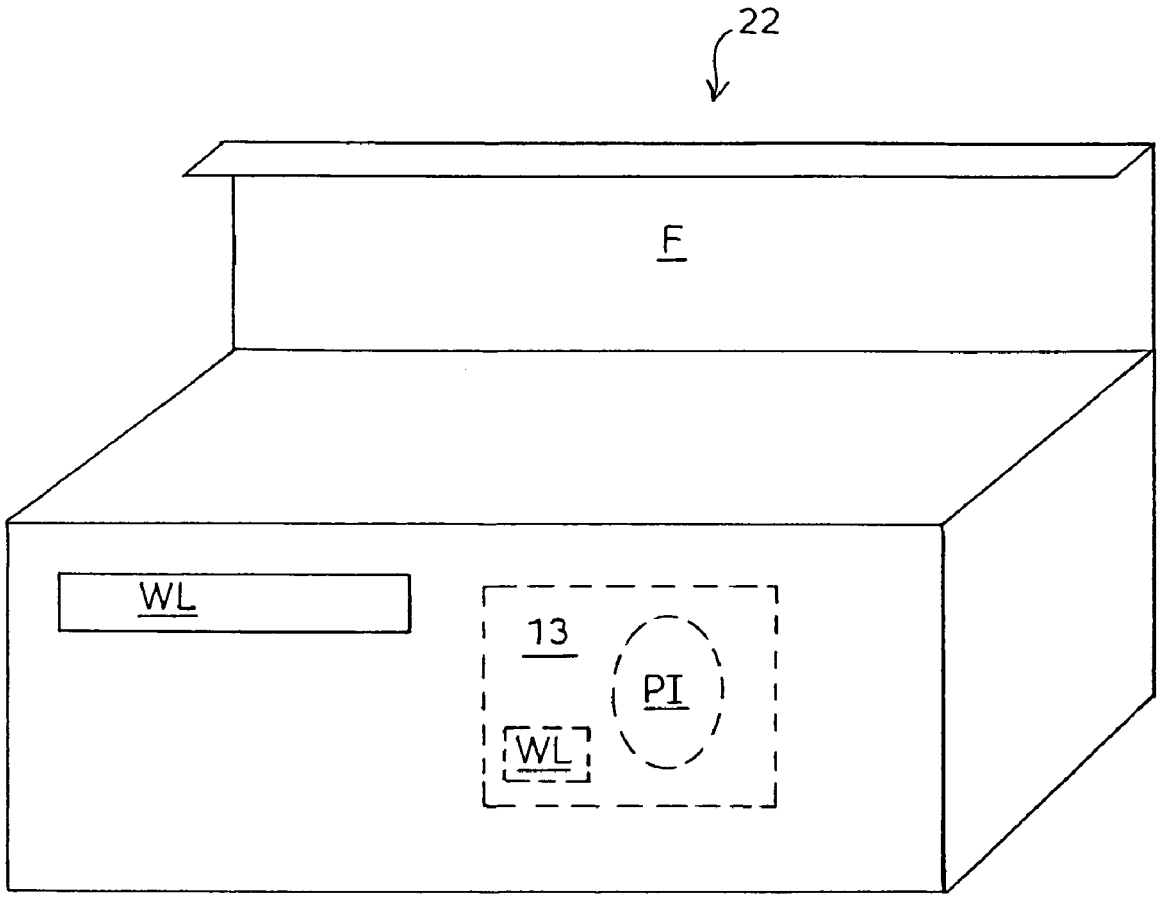
FIG. 4 is a perspective view of a suitable, optional large container or box into which can be placed the bag bottom portion having a stored item or items, as illustrated in FIG. 3B.

Illustrated in FIG. 4 is optional large container or box 22. After contaminated personal items PI have been placed in bag 10 having warning label WL and bag 10 has been closed and main portion 13 separated from detachable segment 12, then closed bag main portion 13 containing personal items PI should be placed in box 22. Box 22 is then closed, illustrated by conventional closure flap F in FIG. 4, but various other box closures are known in the art. Preferably, box 22 also has warning label WL disposed on an exterior surface, in order to give appropriate warning to any personnel who might handle closed bag main portion 13 containing contaminated items PI. As is well known for containers or boxes, container or box 22 may have a handle (not shown) for convenience in carrying container or box 22.

As is known in the art, warning labels WL may be pre-printed onto bag 10 and/or box 22, or may be in the form of pull-off adhesive strips, disposed on a backing of plastic, paper, and the like, so that the strip is pulled off the backing and then placed onto bag 10 and/or box 22, to which the strip adheres due to the adhesive. Box 22 may be collapsible, as is known in the art, so that collapsed box 22 and/or warning labels WL in the form of pull-off adhesive strips, disposed on a backing, can be part of the kit and easily placed in container 20, along with various bags 10 and optionally with writing device WD.

EXAMPLE

A kit comprising container 20 having therein one or more bags 10, and preferably also having writing device WD, collapsed box 22, and/or warning labels WL in the form of pull-off adhesive strips, is taken by an emergency worker to an emergency area where there are one or more injured persons, ill persons, or deceased persons, each having personal items PI.

Once one or more personal items PI have been removed by the emergency worker from a relevant person, and placed in bag 10, then the emergency worker closes bag 10 via closure member 16, preferably comprising a tamper evident adhesive seal. More specifically, closure member 16 may comprise an adhesive area that is covered with a pull-off protective cover strip, typically of plastic, paper, and the like, so that the protective cover strip is pulled off, and the uncovered adhesive area is folded over to close bag 10 at bag mouth area 11, or closure member 16 may be another type of closure device, such as mating male and female profiles, for instance, those provided under the above-mentioned ZIPLOC® trademark.

Either prior to or after closure of bag 10, segment 12 of bag 10 is detached by the emergency worker from bag main portion 13 of bag 10 by way of a perforated tear strip 14 in bag 10, near bag mouth area 11. After segment 12 has been detached from bag main portion 13, the emergency worker tags the relevant person with segment 12 as follows.

Optionally, aperture 15 in segment 12 may be provided with a stretchable band, such as rubber band RB, connected there through. Then, after segment 12 is detached, the emergency worker can tag the relevant person such as by placing rubber band RB around the person's wrist or ankle. Alternatively instead of rubber band RB, detachable segment 12 optionally may be provided with a pointed arrow-head portion AHP adapted for insertion into aperture 15. Then, after segment 12 is detached, it forms a tie, and the emergency work can use the tie to tag the relevant person such as by inserting arrow-head portion AHP into aperture 15 with the tie around the person's wrist or ankle.

Either prior to or after closure of bag 10, the emergency worker employs optional writing device WD, or his/her own writing device, and records information on recordation area RA of main portion 13 of bag 10. Writing such information on recordation area RA may be prior to, but preferably is after storage of the person's personal items PI in bag 10. Recorded on recordation area RA of bag 10 is the person's personal information such as: a) a list of the items stored, along with the date, time and location that the items were removed and stored; b) the name, gender, DOB/age, general medical condition and the intended destination of the relevant person; c) the name and identification number of the personnel who removed and stored the items; and d) a notation regarding any contaminated property that might be separately stored. This storage of contaminated items, if any, typically is in another separate plastic bag 10 having warning label WL, and the emergency worker writes on a portion of warning label WL what the dangerous and/or hazardous contaminants are, if the emergency worker knows what are the chemical, radiological, or biological agent(s), or if the worker does not know, then the worker writes a notation that the items are contaminated with an unknown dangerous and/or hazardous contaminant. Separate bag 10 is placed in large box 22, where box 22 preferably also has hazard warning label WL, in order to give appropriate warning to any personnel who might handle bag 10 with the contaminated items.

Later on, the emergency worker or others are able to associate with which injured, ill, or deceased person the stored personal items PI belonged by using a conventional bar code scanner to scan bar code number BCN disposed on detachable segment 12, and corresponding bar code number BCN on an exterior surface of bag main portion 13, whereby the emergency worker or others are able to reunite injured and/or ill persons with their stored personal items PI after the event, or able to associate with which deceased person stored personal items PI belonged.

Although the present invention has been shown and described in detail with regard to only a few exemplary embodiments of the invention, it should be understood by those skilled in the art that it is not intended to limit the invention to specific embodiments disclosed. Various modifications, omissions, and additions may be made to the disclosed embodiments without materially departing from the novel teachings and advantages of the invention, particularly in light of the foregoing teachings. Accordingly, it is intended to cover all such modifications, omissions, additions, and equivalents as may be included within the spirit and scope of the invention as defined by the following claims.

What is claimed is:

1. A closable bag for use in storing an item or items removed from injured, ill, or deceased persons comprising: a flexible, plastic bag, having:

a bag mouth area providing an opening to the bag, a detachable segment disposed in the mouth area and having an aperture and having a bar code on an exterior surface of the detachable segment, a bag main portion having a recordation area on an exterior surface of the bag main portion and the recordation area being for recording personal information for the person whose item or items are removed, and the bag main portion having a corresponding bar code on an exterior surface of the bag main portion, a closure member in the bag main portion and near the bag mouth area and the closure member being chosen from (a) mating male and female profiles for closing the bag main portion or (b) an adhesive area that is covered with a pull-off protective cover strip for closing the bag main portion, and a line of perforations disposed between the closure member and the opening to the bag mouth area, and the perforations being for tearing in order to detach the detachable segment from the bag main portion.

2. The closable bag of claim 1, further including a warning label disposed on an exterior surface of the bag main portion.

3. The closable bag of claim 1, wherein the aperture in the detachable segment is provided with a stretchable band connected there through, or the detachable segment is provided with a pointed arrow-head portion adapted for insertion into the aperture.

4. A kit comprising:

one or more closable bags for use in storing an item or items removed from injured, ill, or deceased persons, each bag comprising: a bag mouth area providing an opening to the bag, a detachable segment disposed in the bag mouth area and having an aperture and having a bar code on an exterior surface of the detachable segment, a bag main portion having a recordation area on an exterior surface of the bag main portion and the recordation area being for recording personal information for the person whose item or items are removed, and the bag main portion having a corresponding bar code on an exterior surface of the bag main portion, a closure member in the bag main portion and near the bag mouth area and the closure member being chosen from (a) mating male and female profiles for closing the bag main portion or (b) an adhesive area that is covered with a pull-off protective cover strip for closing the bag main portion, and a line of perforations disposed between the closure member and the opening to bag mouth area, and the perforations being for tearing in order to detach the detachable segment from the bag main portion; and a container adapted for storing the bag or bags.

5. The kit of claim 4, further including one or more of:

(a) one or more warning labels, each label being disposed on an exterior surface of a bag main portion, being adapted for disposition on an exterior surface of a bag main portion, or a combination thereof, (b) a collapsible box, or (c) a writing device, whereby the container is adapted for storing the storing the bag or bags, the warning label or labels, the writing device, and the collapsible box.

6. The kit of claim 4, wherein the aperture in the detachable segment is provided with a stretchable band connected there through, or the detachable segment is provided with a pointed arrow-head portion adapted for insertion into the aperture.

7. A method comprising:

(1) taking to an emergency area where there are one or more injured persons, ill persons, or deceased persons, a kit comprising a container having therein:

one or more closable bags, each bag having a bag mouth area providing an opening to the bag, and each bag being for use in storing an item or items removed from an injured, ill, or deceased person, a detachable segment disposed in the mouth area and having an aperture and having a bar code on an exterior surface of the detachable segment, a bag main portion having a recordation area on an exterior surface of the bag main portion and the recordation area being for recording personal information for the person whose item or items are removed, and the bag main portion having a corresponding bar code on an exterior surface of the bag main portion, a closure member in the bag main portion and near the bag mouth area and the closure member being chosen from (a) mating male and female profiles for closing the bag main portion or (b) an adhesive area that is covered with a pull-off protective cover strip for closing the bag main portion, and a line of perforations disposed between the closure member and the opening to bag mouth area, and the perforations being for tearing in order to detach the detachable segment from the bag main portion; and (2) removing a bag from the container, removing one or more personal items from an injured person, an ill person, or a deceased person, and placing the item or items in the bag; and (3) followed by in any order:

closing the bag via the closure member;

detaching the detachable segment from the bag main portion by way of the perforations;

tagging the injured person, ill person, or deceased person with the detached segment; and recording personal information for the person on the recordation area.

8. The method of claim 7, further including in the kit one or more of:

(i) a writing device, (ii) a collapsible box, or (iii) one or more warning labels, each label being disposed on an exterior surface of a bag main portion, being adapted for disposition on an exterior surface of a bag main portion, or a combination thereof.

9. The method of claim 7, wherein tagging a person is accomplished by the detachable segment being provided with a stretchable band connected through the aperture, or by the detachable segment being provided with a pointed arrowhead portion adapted for insertion into the aperture.

* * * * *